US009725941B2

(12) United States Patent
Van Tassell, III

(10) Patent No.: US 9,725,941 B2
(45) Date of Patent: Aug. 8, 2017

(54) SYSTEM AND DEVICE FOR OPENING AND CLOSING SLIDING DOORS

(76) Inventor: Ronald E. Van Tassell, III, West Palm Beach, FL (US)

( * ) Notice: Subject to any disclaimer, the term of this patent is extended or adjusted under 35 U.S.C. 154(b) by 1433 days.

(21) Appl. No.: 12/728,207

(22) Filed: Mar. 20, 2010

(65) Prior Publication Data

US 2011/0225885 A1 Sep. 22, 2011

(51) Int. Cl.

| | |
|---|---|
| ***E05F 11/00*** | (2006.01) |
| ***E05F 15/641*** | (2015.01) |
| ***E05F 15/60*** | (2015.01) |
| ***E05F 15/635*** | (2015.01) |
| ***E05F 15/77*** | (2015.01) |

(52) U.S. Cl.

CPC ..... *E05F 15/641* (2015.01); *E05F 15/60* (2015.01); *E05F 15/635* (2015.01); *E05F 15/77* (2015.01); *E05Y 2201/434* (2013.01); *E05Y 2201/722* (2013.01); *E05Y 2400/614* (2013.01); *E05Y 2400/628* (2013.01); *E05Y 2600/452* (2013.01); *E05Y 2600/46* (2013.01); *E05Y 2800/00* (2013.01); *E05Y 2900/132* (2013.01)

(58) Field of Classification Search

CPC ..... E05F 15/641
USPC ..... 49/358, 360, 324
See application file for complete search history.

(56) References Cited

U.S. PATENT DOCUMENTS

| | | | | |
|---|---|---|---|---|
| 620,006 | A | | 2/1899 | Williams |
| 873,175 | A | | 12/1907 | Sayre |
| 1,315,308 | A | | 9/1919 | Homan |
| 2,054,898 | A | | 9/1936 | Edwards |
| 2,334,981 | A | | 11/1943 | Ackley |
| 3,137,491 | A | | 6/1964 | Coenen |
| 3,324,594 | A | * | 6/1967 | Hettinger et al. ..... 49/28 |
| 3,403,474 | A | | 10/1968 | Spasoff |
| 3,533,188 | A | | 10/1970 | Jones et al. |
| 3,890,744 | A | | 6/1975 | Galis |
| 3,981,203 | A | | 9/1976 | Williams |
| 4,050,189 | A | | 9/1977 | Peterson |
| 4,067,144 | A | | 1/1978 | Ogishi |
| 4,541,202 | A | | 9/1985 | Dockery |
| 4,577,577 | A | | 3/1986 | Eriksson |
| 4,738,052 | A | | 4/1988 | Yoshida |
| 4,754,572 | A | * | 7/1988 | Bilt ..... 49/358 |
| 4,893,435 | A | | 1/1990 | Shalit |
| 5,216,782 | A | * | 6/1993 | Schenck et al. ..... 16/194 |
| 5,422,552 | A | | 6/1995 | Parisi |
| 5,656,898 | A | | 8/1997 | Kalina |
| 5,711,112 | A | | 1/1998 | Barten et al. |

(Continued)

*Primary Examiner* — Katherine Mitchell
*Assistant Examiner* — Catherine A Kelly
(74) *Attorney, Agent, or Firm* — Clay McGurk; The Law Office of Clay McGurk

(57) ABSTRACT

A system and portable device are provided for opening and closing sliding doors associated with conventional sliding doors as used in residences and businesses. The portable sliding door device attaches to a sliding door via a bracket, and moves along the same track used by the sliding door. The sliding door device can be initiated to move the sliding door to the open position through remote control, voice-activation, and proximity transmitters. The sliding door device can communicate with wireless routers and be remotely controlled and monitored by computers, netbooks and cell phones. The sliding door device has safety features, including cameras and speakers to ward off attempted break-ins.

19 Claims, 5 Drawing Sheets

(56) References Cited

U.S. PATENT DOCUMENTS

| | | | | |
|---|---|---|---|---|
| 5,878,530 | A | 3/1999 | Eccleston et al. | |
| 5,930,954 | A | 8/1999 | Hebda | |
| 6,343,436 | B1 * | 2/2002 | Milano et al. | 49/362 |
| 6,581,332 | B1 * | 6/2003 | Kim | 49/358 |
| 6,691,465 | B1 | 2/2004 | Stephan | |
| 6,918,210 | B1 | 7/2005 | Smiley | |
| 7,025,106 | B2 | 4/2006 | Donnelly | |
| 7,213,369 | B2 * | 5/2007 | Freeman | 49/358 |
| 7,310,911 | B1 | 12/2007 | Sellman | |
| 7,418,800 | B1 | 9/2008 | Sellman | |
| 2002/0053169 | A1 | 5/2002 | Menuzzo | |
| 2002/0117982 | A1 * | 8/2002 | Jehn | 318/280 |
| 2002/0157317 | A1 | 10/2002 | Valencia et al. | |
| 2004/0104001 | A1 | 6/2004 | Donnelly | |
| 2005/0235570 | A1 | 10/2005 | Ginzel | |
| 2007/0271850 | A1 * | 11/2007 | Mickelson | 49/358 |
| 2008/0302015 | A1 * | 12/2008 | Thorne | 49/70 |
| 2009/0077898 | A1 | 3/2009 | Gerichten | |
| 2009/0193717 | A1 * | 8/2009 | Ebbe et al. | 49/324 |
| 2010/0242369 | A1 * | 9/2010 | Laird | 49/358 |

* cited by examiner

SYSTEM AND DEVICE FOR OPENING AND CLOSING SLIDING DOORS

FIELD OF THE INVENTION

The present invention relates generally to the field of a system for opening and closing sliding doors, and more particularly to a system and a portable device for opening and closing sliding glass doors in residential and/or commercial dwellings where such device operates on and along the track of the sliding glass door.

BACKGROUND OF THE INVENTION

Sliding glass door assemblies are commonplace in both residential and commercial dwellings. A sliding door is mounted on a horizontal track in offset alignment with a separate, fixed door or panel. When a person desires to enter or leave through the sliding door, the person opens the latch and slides the sliding door along the track to open the door, and then slides the door back to the closed position and locks the door.

Sliding door devices have been invented to open sliding doors for the elderly, those who are physically challenged, or someone seeking additional convenience by the assistance of a powered device to open and close the sliding door. In many of the prior art designs, the powered sliding door devices were installed and mounted outside of the sliding door assembly. These devices also required a specialist or technician who would know how to assemble the device, and then install and mount such device to the sliding door assembly and corresponding wall or other fixed surface. The assembly, installation and mounting of the devices can be difficult due to the many parts of the powered device, and possibly to complicated electrical wiring and hydraulic systems. Since these powered door openers were fixed into a surrounding wall, these devices were not portable and could not be easily moved from one sliding door assembly to another. The powered device would have to be completely removed and disassembled before it could be installed in another location.

One of the disadvantages of the prior art devices is that in many instances, the door frame, and sometimes the sill or jamb, or surrounding wall area, had to be structurally altered for the devices to be mounted for operation. This poses many problems which involve whether the integrity of the surrounding wall or door frame was suitable and durable for mounting purposes. Once mounted, these powered devices also had the problem of having an obstacle at or near the passageway of the sliding door.

When a pet (e.g., dog, cat) wants to go outside, the owner of the pet must open and close the sliding door. Sometimes a pet door is installed in the sliding door, or to another separate piece which fits between the sliding door and the building. There is no way for the pet to open a sliding door on their own. If an owner is away for extended periods of time, this can cause the pet great inconvenience, and usually the owner as well, since the owner will be forced to clean up after a pet that was unable to go outside.

Therefore, what is needed is a motorized device for opening and closing sliding doors that requires little or no assembly. What also is needed is a motorized device that can be easily mounted to a sliding door. What is also needed is a power-driven device that is programmable and gives the operator options for opening the door to desired openings and at variable speeds. Yet another need is for a power-driven device that is fully compatible with an existing security system or functions independently as it own security system. What is also needed is a device for a sliding door to open and close when a pet wants to go outside or come inside.

SUMMARY OF THE INVENTION

Accordingly, the present invention is directed to a power-driven device for opening/closing sliding doors that substantially obviates one or more of the problems due to limitations and disadvantages of the related art.

An object of the present invention is to provide a motorized device for opening/closing sliding doors that requires little or no assembly.

Another object of the present invention is to provide a motorized device for opening/closing sliding doors that is portable from one sliding door assembly to another.

Yet another object of the present invention is to provide a power-driven device for opening/closing sliding doors that is controlled by a programmable remote controller.

Another object of the present invention is to provide a portable, motorized device for opening/closing sliding doors that is easily and efficiently manufactured and marketed.

Yet another object of the present invention is to provide a device for opening/closing sliding doors that can be programmed, monitored and managed by a variety of remote devices, including remote controllers, computers and cell phones.

One embodiment of the present invention is a motorized device for opening/closing sliding doors that comprise a battery, at least one wheel, a servo coupled to the at least one wheel and coupled to the battery, and a controller coupled to the servo and battery, for controlling the servo to rotate the at least one wheel along the track in one direction to open the sliding door and for controlling the servo to rotate the at least one wheel along the track in the opposite direction to close the siding door.

Another embodiment of the present invention is a system for opening and closing sliding doors, comprising a device including, a battery, at least one wheel, a servo coupled to the at least one wheel and coupled to the battery, a controller coupled to the servo and battery, for controlling the servo to rotate the at least one wheel along the track in one direction to open the sliding door and for controlling the servo to rotate the at least one wheel along the track in the opposite direction to close the siding door; and a remote device for communicating with the controller to operate the device.

It is to be understood that both the foregoing general description and the following detailed description are exemplary and explanatory and are intended to provide further explanation of the invention as claimed and not to limit it. Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENT

Reference will now be made in detail to the preferred embodiments of the present invention, examples of which are illustrated in the accompanying drawings.

Figure 1:
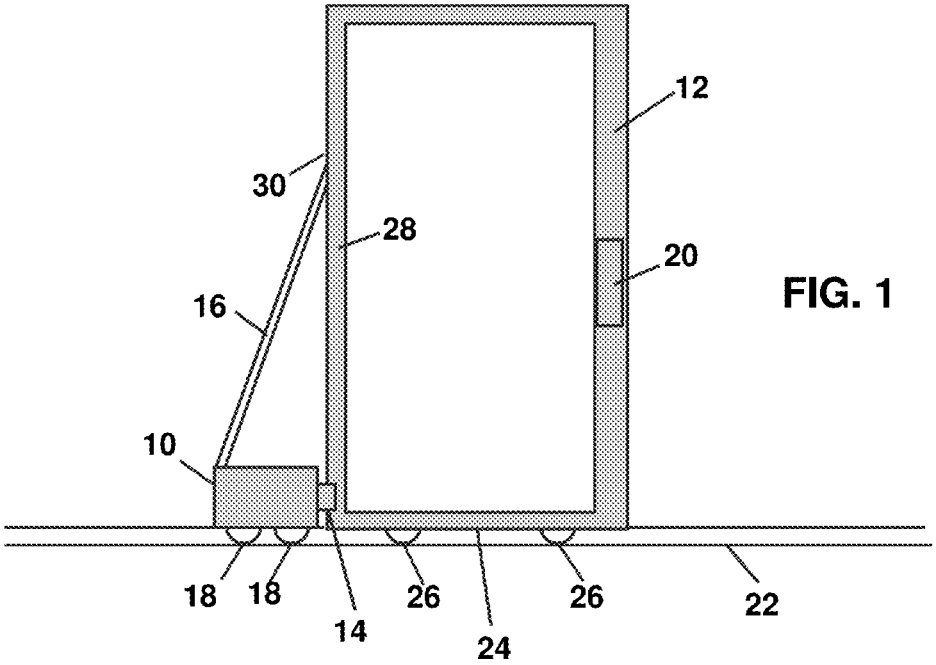
FIG. 1 illustrates a two-dimensional front perspective view of a device for opening and closing sliding doors according to a preferred embodiment of the present invention.

FIG. 1 illustrates a two-dimensional front perspective view of a device for opening and closing sliding doors according to a preferred embodiment of the present invention. The device for opening and closing sliding doors may be also referred to as a slider, opener, closer, machine, apparatus, gadget or other equivalent term. As shown in FIG. 1, device 10 opens and closes sliding door 12. Device 10 attaches to or is mounted to sliding door 12 via mounting bracket 14 and optionally, mounting bar or bracket 16. Device 10 slides along and on the sliding door track 22 via wheels 18. Although sliding door track 22 is shown in FIG. 1, it is understood that track 22, the bottom 24 of the sliding door 12, and rollers 26 of sliding door 12 are usually recessed into the frame of the sliding door and are not visible when installed in a building.

Figure 2:
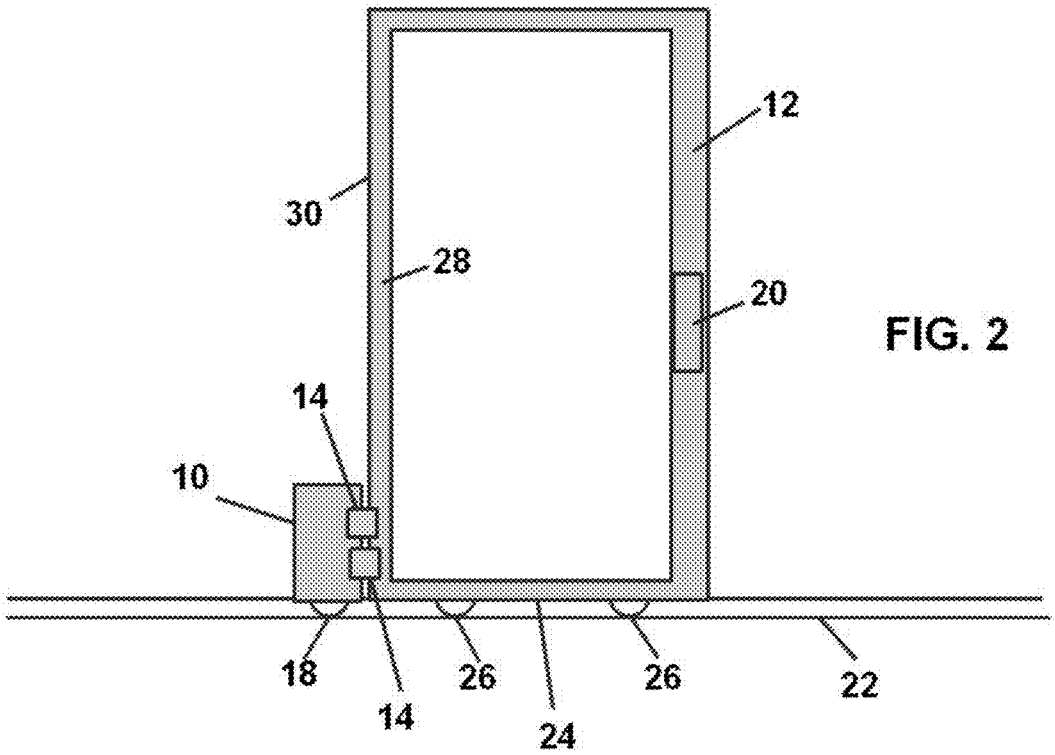
FIG. 2 shows a two-dimensional front perspective view of a device for opening and closing sliding doors according to an alternative embodiment of the present invention.

Device 10 is a rectangular box and preferably is manufactured out of steel. However, other materials other than such as aluminum, plastic or other durable metals may be used. Device 10 preferably is in the horizontal position, as shown in FIG. 1. However, in an alternative embodiment, device 10 can be positioned in the vertical position as shown in FIG. 2. FIG. 2 shows a two-dimensional front perspective view of a device for opening and closing sliding doors according to an alternative embodiment of the present invention. Instead of device 10 having two wheels 18 (as in FIG. 1), device 10 of FIG. 2 has one wheel 18. One advantage of the alternative embodiment is that sliding door 12 can be opened more than when device 10 is in the horizontal position.

The width of device 10 is made to fit within the dimensions of the sliding door without touching or scraping along the fixed glass (or other material) panel. In alternative embodiments, the width of device 10 could be larger than the width of the sliding door 12. This however means that there be a slight protrusion beyond the width of the sliding door 12.

Mounting bracket 14 is used to attach device 10 to sliding door 12. Mounting bracket 14 is preferably made from steel or some other type of metal, but other durable materials may be used as well, such as plastic for example. Mounting bracket 14 has two holes at opposite end of the bracket 14, where a screw is inserted to attach and hold mounting bracket 14 to device 10 and sliding door 12. As shown in FIG. 1, mounting bracket 14 attaches to the side of device 10 and to the side 28 of sliding door 12. The holes for where the screws would penetrate into device 10 would be drilled in advance. Instead of using screws to attach the mounting bracket 14 to device 10, some alternatives for attaching the bracket to device 10 and sliding door 12 may include super glue, some other durable, long-lasting adhesive that adjusts well to different climate and temperature zones, and Velcro, for example. In addition to the screws, steel or rubber washers may also be used to provide a level of insulation when a hole is made in sliding door 12.

Mounting bracket 14 may be fixed in length or adjustable. Device 10 may be flush with sliding door 12, or there may be a distance separating device 10 from sliding door 12. Although mounting bracket 14 is a straight, rectangular piece of steel with two holes at opposite ends, in alternative embodiments, mounting bracket 14 could be a "u"-shaped bracket that mounts to one end of device 10 and the rear portion 30 of sliding door 12. Mounting bracket 14 could also be a "L"-shaped bracket that attaches to the top of device 10 and the rear portion 30 of sliding door 12. In another alternative embodiment, mounting bracket 14 could also be a "L"-shaped bracket that attaches to the side of device 10 and the rear portion 30 of sliding door 12.

Although FIG. 1 only shows one mounting bracket 14, in alternative embodiments more than one mounting bracket 14 may be used (such as shown in FIG. 2). For example, two mounting brackets 14 may be mounted to the side of device 10 and the side of sliding door 12. In another example, one mounting bracket 14 may be mounted to the top of device 10 and the rear portion of sliding door 12, and a second mounting bracket 14 may be mounted to the side of device 10 and the side 28 of sliding door 12.

An optional feature of the present invention is mounting bar or bracket 16. Mounting bar 16 is preferably a steel round or rectangular bar that extends from device 10 to some place along the side 28 or rear 30 of sliding door 12. Mounting bar 16 helps in stabilizing sliding door 12 when it is being opened and closed, especially in those cases where sliding door 12 is older and harder to move, than a newer or newly installed sliding door. Mounting bar 16 would have holes in opposite ends where screws could be inserted to attach mounting bar 16 to device 10 or sliding door 12. Mounting bar 16 may be fixed in length or adjustable.

It is preferred that latch 20 is an commercially available, electronic latch that is capable of wirelessly communicating with device 10. The electronic latch 20 may include a keypad to enter a specific code to open the door 12. However, latch 20 can be a non-electronic, regular latch that has to be manually opened and closed. With the push of a button, device 10 can automatically open, close and safely and securely lock sliding door 12. What follows is an example of a sequence of events to open the sliding door 12. First, a signal is sent to device 10 to open sliding door 12. Second, device 10 then sends a signal to latch 20 to move to the open position. If latch 20 is non-electronic, then latch 20 must physically be opened. Thereafter, device 10 either waits for an acknowledgment that the latch 20 is open, or after the expiration of a period of time, starts to move by pulling sliding door 12 open. Once device 10 has reached the desired open position, device 10 either waits for a signal to close or will close after an expiration of a period of time. Whereupon, device 10 will start to move by pushing the sliding door 12 into the closed position. Once in the closed position, device 10 will send a signal to latch 20 to close. Latch 20 will then close and lock.

The signal to open sliding door 12 can be sent in a variety of different ways. In the preferred embodiment, the "open" signal could be sent by a handheld, remote, wireless device. Alternatively, the signal could be sent via a button or keypad on the sliding door or mounted to a wall or counter, or via a button or switch on the device 10 itself. In yet another embodiment, electronic latch 20 may send the signal when a person physically opens the latch and/or enters a code on a keypad on latch 20. In also another embodiment, a pad that lays on the floor could transmit an open signal when either a person or pet steps onto it. In another embodiment, a commercially available proximity transmitter could transmit an open signal to device 10 when within a certain area by device 10. The proximity transmitter could be attached to pets, wheelchairs, people and canes, for example. In yet another embodiment, a cellular phone (such as an iPhone) could run an application that displays the functions of the remote controller and would transmit the "open" signal after the user activated such function. In another embodiment, a voice-activated signal could be sent—such as a person speaking the word "open". In some of these methods, the "open" signal could be encrypted or software could be used to assure that a new code is sent every time the "open" signal is sent. Encryption provides an additional level of security.

The "close" signal will be sent internally to device 10 (via controller 70 discussed below) after a predetermined or programmable period of time. For example, the period of time could be five seconds from the time device 10 and sliding door 12 reach the open position. Therefore after five second, device 10 would begin the sequence of events to close sliding door 12. Alternatively, the devices mentioned in the previous paragraph could send or transmit a "close" signal to device 10. If a proximity transmitter transmitted an "open" signal as discussed above, once the pet or object moves away from sliding door 12 and is out-of-range for device 10 to receive the "open" signal, then device 10 would initiate the sequence of events to close sliding door 12.

Figure 3:
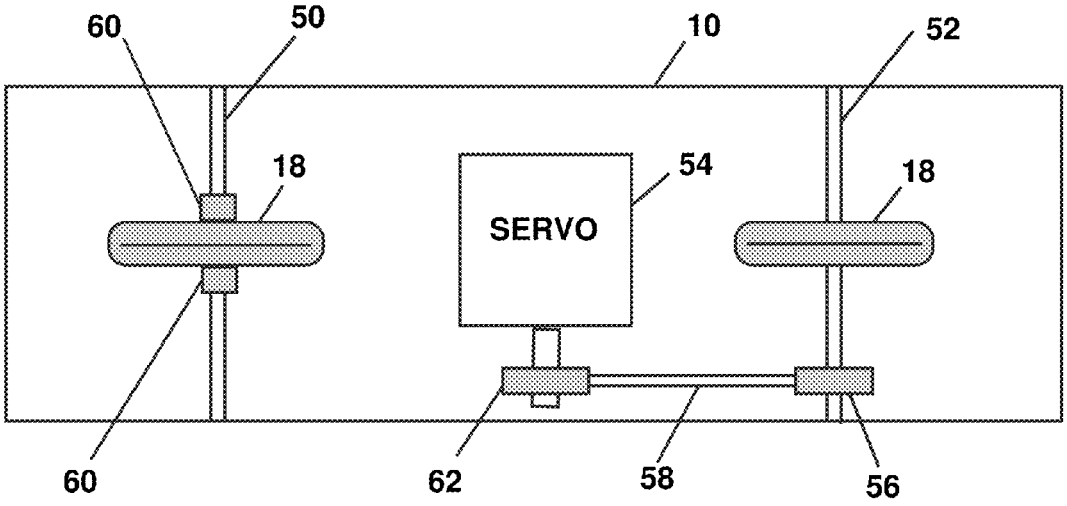
FIG. 3 shows a top-side, two-dimensional view of device 10 according to a preferred embodiment of the present invention.

FIG. 3 shows a top-side, two-dimensional view of device 10 according to a preferred embodiment of the present invention. As shown in FIG. 3, device 10 comprises two axles 50, 52 that support two wheels 18, servo 54, sprocket 56, chain 58, and sprocket 62. There are additional parts of device 10 that are not shown in FIG. 3 but in later figures. Although not shown, device 10 may optionally include a weight. The purpose of this additional weight is to provide a force to hold device 10 down onto sliding door track 22. The additional weight may be distributed evenly across the horizontal direction via a plate, or at some specific location in device 10.

Wheels 18 are centered within device 10 to slide, roll or ride along sliding door track 22. Wheels 18 are commercially available, and can be similar to those used in the sliding doors 12, where the wheel or roller has an indentation so as to roll along and stay aligned onto track 22. Wheels 18 may also made of steel, another metal or some other softer type of material that provides greater traction and friction with the surface of the sliding door assembly, for example rubber or plastic. Each of the wheels 18 are also in line or aligned in the same axis with each other. Wheel 18 on axle 50 moves freely around axle 50, and helps support device 10. Wheel 18 of axle 50 is held into place by washers 60 that fit onto axle 50 and on either side of wheel 18. Washers 60 may be steel, plastic, rubber or some other durable material. Washers 60 are preferably fixed in location on axle 50. Wheel 18 is fixed or coupled to axle 52, and will only rotate when axle 52 rotates.

In an alternative embodiment, wheels 18 may have some material, for example rubber or plastic, that provides a grip on track 22. The material is located on the inside of the wheels, or in the area of the recess where wheel 18 comes into contact with track 22. This material provides greater traction and friction for wheels 18 when wheels 18 are rolling along track 22.

Wheel 18 will be rotated by servo 54 via a chain and sprocket system which is comprised of chain 58 and sprockets 56, 62, all of which are commercially available. Sprockets 56, 62 are those that have toothlike projections and are used to engage the links of chain 58. Although the chain and sprocket system is connected only to one axle in FIG. 3, in alternative embodiments, the chain and sprocket system could also be connected to axle 50. Two axles 50, 52 would therefore be attached to the chain and sprocket system and be powered by servo 54.

Servo 54 is a commercially available servo that is extremely powerful for its size. Servo 54 provide the torque to move sprocket 62, which in turn moves chain 58 and rotates sprocket 56, thereby forcing axle 52 and wheel 18 to rotate. Servo 54 operates in either direction, so as to move chain 58 and thus device 10 in either direction along track 22 (i.e., opening and closing sliding door 12). In an alternative embodiment, the chain and sprocket system could be replaced with a screw system, where servo 54 turns a screw which then turns a gear which is coupled to axle 52. The rotation of the screw would drive the gear to rotate, thereby rotating axle 52 and wheel 18. In another embodiment, servo 54 could be directly coupled to axle 52 via gears that rotate axle 52 in either direction.

Figure 4:
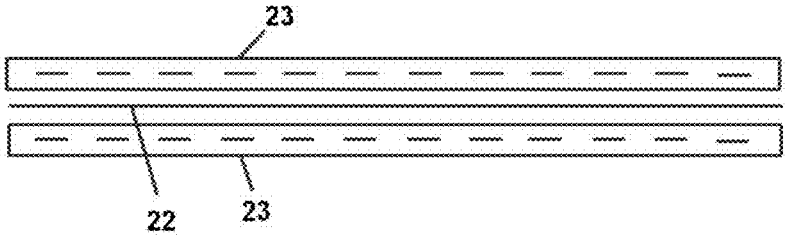
FIG. 4 shows an alternative track according to an alternative embodiment of the present invention.

FIG. 4 shows an alternative track according to an alternative embodiment of the present invention. Track 22 is the track that is centered in the sliding door assembly and is the track used by the wheels of sliding door 12. Gear track 23 is a special track for device 10. As shown in FIG. 4, the track has evenly-spaced indentations, notches or groves. Gear sprocket wheels of device 10 will make contact to or be inserted into the indentations of gear track 23, thus providing greater traction when device 10 is opening/closing sliding door 12. Gear track 23 can be easily installed into the existing sliding door track assembly and can be held into place by commercially available adhesives or other means, such as metal screws for example.

Figure 5:
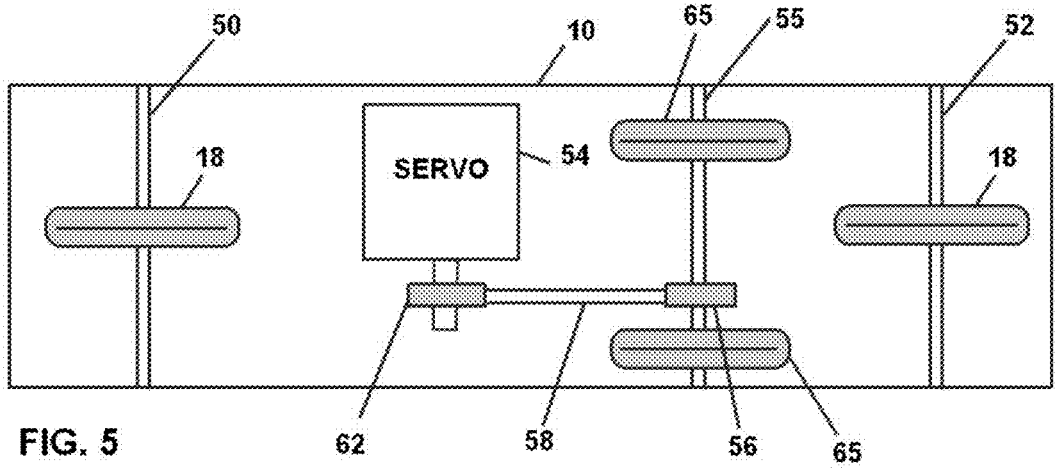
FIG. 5 shows a top-side, two-dimensional view of device 10 according to an alternative embodiment of the present invention.

FIG. 5 shows a top-side, two-dimensional view of device 10 according to an alternative embodiment of the present invention. The parts are similar to those parts described in relation to FIG. 3, however, with the additional feature of sprocket wheels 65. These sprocket wheels 65 are at opposite ends of axle 55 and are positioned or aligned on axle 55 so that each of the sprocket wheels 65 will make contact with their portion of the gear track 23 as shown in FIG. 4.

Figure 6:
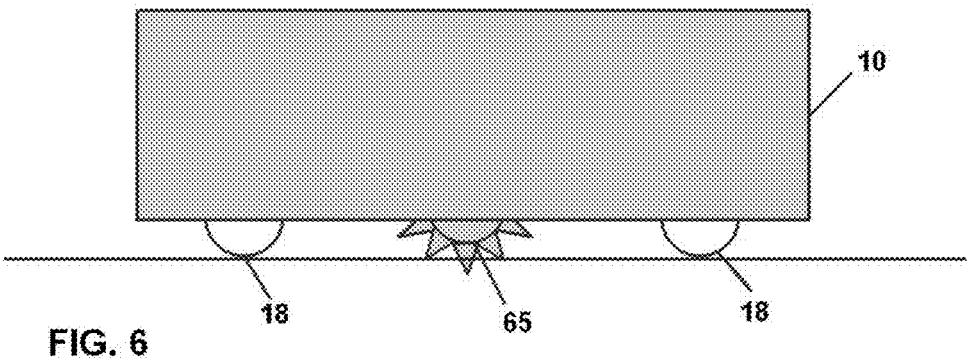
FIG. 6 shows a side, two-dimensional view of device 10 according to an alternative embodiment of the present invention.

FIG. 6 shows a side, two-dimensional view of device 10 according to an alternative embodiment of the present invention. As shown in FIG. 6, device 10 comprises two wheels 18 and two sprocket wheels 65 (although only one is shown). Sprocket wheel 65 is a wheel rimmed with toothlike projections, used to engage the indentations, notches or groves of gear track 23 (of FIG. 3). As can readily be seen, when device 10 turns sprocket wheels 65, this provides better power, control and traction for opening/closing sliding door 12 than using conventional wheels 18 (shown in FIG. 3).

In an alternative embodiment, instead of using to sprocket wheels 65 as shown in FIG. 6, wheels 65 may just be wheels without sprockets made of steel, metal, plastic, rubber or some other durable material. Wheels 65 may be on their own axle 55, or may even be on the same axle 52 as wheel 18 (see FIG. 5) if device 10 is oriented in the vertical direction rather than the horizontal direction. This means that wheels 18 and 65 will rotate and be controlled via servo 54. Having two wheels 65 rotate on a different portion of the sliding door assembly rather than on track 22, provides extra traction and friction to control the movement of sliding door 12. However wheel(s) 18 provide the necessary movement along track 22 so that sliding door 12 will stay aligned in the sliding door assembly and not rub or scratch the fixed glass panel.

Figure 7:
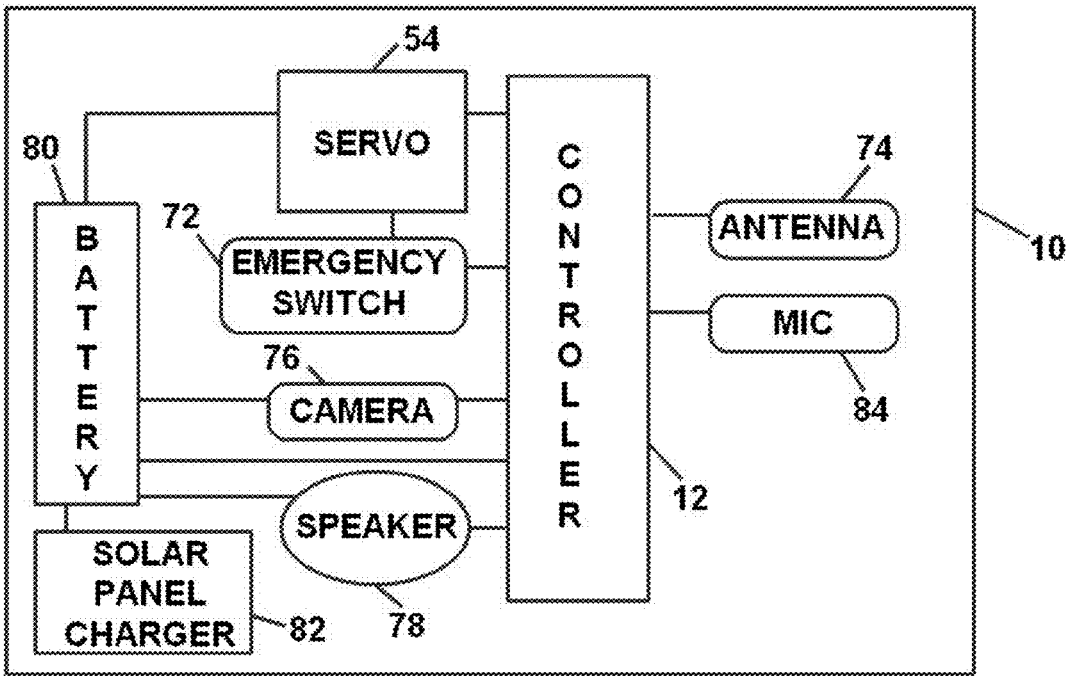
FIG. 7 shows a block diagram of a device for opening and closing sliding doors according to a preferred embodiment of the present invention.

FIG. 7 shows a block diagram of a device for opening and closing sliding doors according to a preferred embodiment of the present invention. Device 10 comprises servo 54, controller 70, emergency switch 72, antenna 74, camera 76, speaker 78, battery 80 and solar panel charger 82.

Controller 70 includes a microprocessor and memory that is responsible for controlling all the functions and features of device 10, such controlling the opening and closing of sliding door 12. As shown in FIG. 7, controller 70 is coupled to servo 54, emergency switch 72, antenna 76, speaker 78 and battery 80. Controller 70 communicates with a remote device via antenna 74. Signals are transmitted between a remote device and controller 70 via antenna 74. These signals include signals to open and close the sliding door 12. Controller 70 may be programmed via uploading the software via antenna 74 from a wireless networking device or a home-based computer, or via a laptop with a wireless connection. Alternatively, controller 70 could be programmed with software via insertion of a USB 2 device into a port (not shown), that will automatically download the software after insertion. Additionally, controller 70 could be programmed via a computer where a cable (e.g., USB 2 cable) manually connected device 10 to the computer.

Controller 70 is responsible for communicating signals to servo 54 to open and close sliding door 12. The "open" signal would instruct servo 54 to rotate or move in a particular direction, whereby device 10 would slide along track 22 and open sliding door 12. The distance by which device 10 opens sliding door 12 can be programmed or preselected from predetermined distances. The "close" signal would instruct servo 54 to rotate or move in the opposite direction so that device 10 would roll along track 22 to move sliding door 12 into the closed position. Controller 70 will monitor servo 54 to determine if extra force is being applied by servo 54. If so, such a condition may signal that the door is fully closed.

If someone was attempting to break-in the building by forcing open sliding door 12, servo could detect the motion and notify controller 70 of the motion. Whereupon, controller 70 could trigger speaker 78 so a loud sound would be emitted for a brief period of time. Controller 70 could also transmit a signal via antenna 74 to the building's security system. The separate security system could then trigger the other alarms and send the appropriate signals to security or police stations, or to send a text to a cell phone of the building's owner/occupant. Alternatively, controller 70 could send a signal directly to a wireless router to notify the police or the owner/occupant about the attempted break-in.

Device 10 is programmable to be fully compatible with many different types of wireless security systems for home and commercial usage.

Controller 70 can be programmed to open sliding door 12 a certain distance for pets and another distance for people. Controller 70 can also be programmed to control how fast sliding door 12 is opened and closed. The speed of opening the door can vary and be different from the speed by which sliding door 12 closes.

A proximity transmitter could be attached to a pet, person or object so that when the pet, person or object is within a certain region or area of sliding door 12, the proximity signal would be received via antenna 74 and transmitted to controller 70. Controller 70 could be programmed to detect whether the pet, person or object was located in the vicinity of the sliding door for a period of time before starting the sequence of events to open sliding door 12. The proximity feature can be disabled using the remote controller or pressing a proximity disable/enable switch (not shown) on device 10.

Controller 70 can be programmed to work with and recognize a variety of optional safety features. For example, safety sensors can be installed around the sliding door assembly that project an invisible, infrared light beam across the sliding door opening. Controller 70 would automatically reverse or open sliding door 12 if anything interrupts the light beam while sliding door 12 is being closed.

Another safety feature that could be programmed into controller 70 is sensing software that will stop sliding door 12 from closing if contact is made with a person or object. For example, if device 10 was moving into the closed position, but a person or pet were still blocking sliding door 12, servo 54 could transmit this information to controller 70 which would determine whether to stop or to start a sequence to open sliding door 12. Servo 54 would detect that something is in the path of track 22 due to the extra force required to roll, slide or move sliding door 12. The sensitivity of servo 54 could be adjusted so that bumps during the closing sequence would not trigger controller 70 to open the door.

Antenna 74 is a commercially available antenna for transmitting and receiving signals within a predetermined distance. Antenna 74 can either be mounted on the outside of device 10, or preferably inside the box of the device 10. As shown in FIG. 7, antenna 74 is coupled to controller 70.

Battery 80 is preferably a rechargeable lithium battery. Battery 80 may be removable through opening the top or side of device 10, or may plug into a port in device 10 which could then be easily removed without opening device 10. As shown in FIG. 7, battery 80 is coupled to servo 54, controller 70, camera 76, speaker 78 and solar panel charger 82. Battery 80 may be charged three different ways. First, solar panel charger 82 may charge battery 80 via solar energy. Solar panel chargers 82 are commercially available and include solar panels for collecting and converting solar energy into electricity. Solar panel charger 82 would be coupled or plug into battery 80. Second, a standard 120V electrical outlet charger would have a cord which could be inserted into battery 80 (either directly or via a port on the outside of device 10 that would be connected to battery 80). Third, battery 80 would be removed and plugged into a standard 120V electrical outlet charger, and then reinserted into device 10 after battery 80 is fully charged. The third option permits device 10 to have multiple rechargeable batteries 80 so while one battery 80 is charging, another battery 80 could be inserted into device 10 to make it operational.

Optional features of device 10 include the emergency switch 72, camera 76, speaker 78 and/or microphone 84. Emergency switch 72 is a safety override switch that will automatically stop device 10 from moving in either direction when switch 72 is pressed. Emergency switch 72 is a physical button, latch or switch located on the outside of device 10 that can be pressed by a person. As shown in FIG. 7, emergency switch 72 is coupled to servo 54 and to controller 70. Emergency switch 72 may optionally disengage servo 54 so that sliding door 12 can be manually be moved in either direction. Device 10 will not start moving in either direction unless device 10 receives another "open" or "close" signal, which will initiate controller 70 to engage servo 54.

Camera 76 is another optional feature of device 10. Camera 76 is a commercially available camera that can be installed inside or outside of device 10 via a port, plug or otherwise. Camera 76 may also be a commercially available web cam. As shown in FIG. 7, camera is coupled to controller 70 and to battery 80. The purpose of camera 76 is to provide a view outside of the door and/or a view of the inside of the building. A "live" feed from camera 76 could be relayed to controller 80, where such feed could be transmitted via antenna 74 to a wireless router (see FIG. 8 below), and thereafter communicated to remote devices, such as a computer or cellular phone for example. Controller 70 could also turn camera 74 on at periodic intervals, where camera 74 would take pictures. The pictures could then be stored in memory of controller 70 to record who or what is entering or exiting a building, especially when the owner of the building is not present.

Speaker 78 is yet another optional feature of device 10. Speaker 78 is a device for emitting a sounds, including alarm sounds and prerecorded voice sounds. For example, the prerecorded words "opening door" would be played on speaker 78 when sliding door 12 was opening, and the prerecorded words "closing door" would be played on speaker 78 when sliding door 12 was closing, for example. As shown in FIG. 7, speaker 78 is coupled to controller 70 and battery 80. If someone was attempting to break into the dwelling, servo 54 would sense the movement of sliding door 54 and notify controller 70 of the movement. Controller 70 could then determine from the signals sent by servo 54 whether the movement was associated with an attempted break-in or something else, like the wind. For example, if servo 54 determined that sliding door 12 moved at least one inch, then such information would be relayed to controller 70 which would determine that a break-in is most likely occurring. Controller 70 would then trigger a sound to be emitted by speaker 78. The intensity and loudness of the emitted sound could be programmable via controller 70 and a remote controller or computer.

Microphone 84 is a commercially available microphone. As shown in FIG. 7, microphone 84 is coupled to controller 70. The purpose of microphone 84 is to make device 10 a voice-activated device. When sounds are received via microphone 84, controller 70 uses an embedded, commercially available speech recognition application or software to determine whether such received sounds are associated with a command, such as "open" (to open sliding door 12) or "close" (to close sliding door 12). If controller 70 determines such voice command words have been received, then controller 70 will initiate the appropriate function. The speech recognition application or software of controller 70 may be programmed to recognize the specific command words (for example "open", "close", "lock" (to lock the electronic latch 20), "off" (to turn device 10 off, or to go into hibernation or stand-by mode) for each member of the household or building.

In another example, when device 10 receives a proximity signal from a proximity transmitter associated with a pet, device 10 may initiate a prerecorded voice, such as "Spot, do you want to go outside?". If the dog barks, then microphone 84 will receive the bark signal, controller 70 will process the signal, and initiate the open door sequence if controller 70 determines that the pet is barking.

Figure 8:
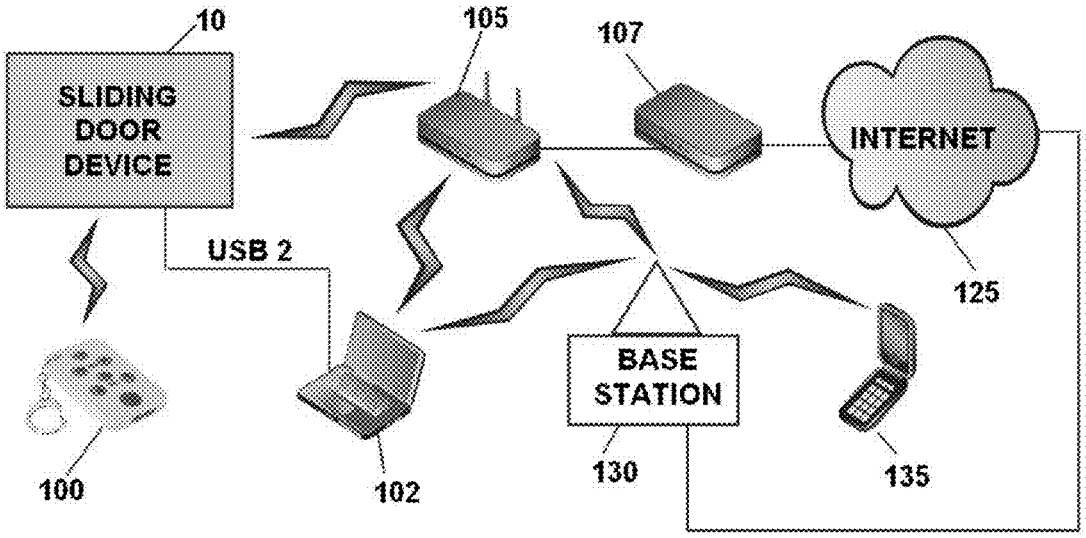
FIG. 8 shows different systems and devices that are able to communicate with a device for opening and closing sliding doors according to a preferred embodiment of the present invention.

FIG. 8 shows different systems and devices that are able to communicate with a device for opening and closing sliding doors according to a preferred embodiment of the present invention. As shown in FIG. 8, device 10 can communicate with remote controller 100. Remote controller 100 may be as simple as having one button to transmit a signal (open and close) to device 10 (similar to a garage door opener). Remote controller 100 may also have a variety of dials and buttons that control different features of device 10, for example: a open/close button (to open/close sliding door 12), person/pet button (to set the sliding door 12 to open/close for a person or pet), proximity enable/disable button, speed dials (to adjust the speed of opening/closing the sliding door 12). The remote controller 100 may have fixed buttons and dials, or could use a touch pad screen that displays the various features and functions of device 10. The touch pad screen may include programmable features of device 10 to adjust the speed of opening/closing door and program device 10 how far to open the door for a person or pet.

As shown in FIG. 8, computer 102 can plug directly into device 10 via some type of connection, such as USB 2 connection, for example. Computer 102 can be any of the commercially available models and makes, either configured as a desk computer, laptop or netbook. Computer 102 could be used for programming device 10. In addition, computer 102 could communicate with device 10 using a wireless connection via wireless router 105.

As shown in FIG. 8, device 10 can establish a wireless communication with wireless router 105. Wireless router 105 is in the same region or area of where device 10 is located, such as a home or business for example. Wireless routers 105 are commercially available and can be installed and set-up using computer 102. Computer 102 can either be connected directly to wireless router 105 via some type of wireless connection or some type of commercially available cable. Computer 102 via wireless router 105 could program and monitor device 10 (including live camera feeds from camera 76 and sounds via microphone 84). Having the wireless router 105 gives a person working on computer 102 at some location in the house or business the option of checking on the status of device 10 and seeing the camera feed from device 10 around sliding door 12.

As shown in FIG. 8, wireless router 105 can be coupled to a modem 107 which is coupled to the Internet or world-wide web 125. Modem 107 can be any of those commercially available, including high-speed DSL or cable modems. This means that remote devices as computers, laptops, netbooks, cellular phones, and any next generation communication devices can communicate remotely with device 10. For example, computer 102 may be part of a home-based network, where computer 102 can communicate with device 10 via wireless router 105. Another example is where computer 102 is a laptop computer used at work or on the road, where computer 102 can communicate with device 10 via gateway base station 130 to Internet 125 to modem 107 to wireless router 105. Gateway base station 130 includes the many types of gateway base stations publicly and privately available (such as those available at coffee houses, restaurants, airports, business networks, and cellular phone infrastructure systems for example).

As shown in FIG. 8, cell phone 135 can remotely connect to device 10 via gateway base station 130, then to the Internet 125, modem 107 and router 105. Cell phone 135 if local to the area of device 10 would have to communicate with a cell tower 130. Cell phone 135 may be able to connect wireless to sliding door device 10 if such cell phone (e.g., iPhone) 135 could execute an application that simulates the features and functions of remote controller 100. In such a case, cell phone 135 would be turned into a remote controller 100, so that device 10 and cell phone 135 could directly communicate and send/receive proper communication signals without going through wireless router 105.

The system shown in FIG. 8 is useful when utilizing a proximity transmitter. For example, instead of having device 10 open sliding door 12 when a proximity transmitter (associated with a pet) is detected, device 10 via controller 70 and antenna 74 may take a picture from camera 76 and send the picture and text to cellular phone 135 via wireless router 105, modem 107, the Internet 125, and gateway base station 130. Upon receipt, the user of cellular phone 135 may text a response such as "open" that will initiate device 10 to open sliding door 12. In another example, upon detection of the proximity signal, controller 70 may transmit a "live" camera feed from a web cam 76 to computer 102 via the Internet 125. Whereupon, the owner can determine whether to open sliding door 12 or not by transmitting an appropriate signal to device 10 via gateway base station 130, the Internet 125, modem 107 and wireless router 105.

While the invention has been described in detail and with reference to specific embodiments thereof, it will be apparent to those skilled in the art that various changes and modifications can be made therein without departing from the spirit and scope thereof. For example, instead of device 10 being a separate and distinct piece from sliding door 12, device 10 could be integrated into the bottom of a sliding door. All the piece and parts would be contained in the sliding door. Thus some or all the parts and pieces shown in FIGS. 3, 5, 6 and 7 could be integrated, included or incorporated into the bottom of a sliding door. Thus, it is intended that the present invention cover the modifications and variations of this invention provided they come within the scope of the appended claims and their equivalents.

What is claimed is:

1. A device for opening/closing a sliding door along a track, the device comprising:
- a battery;
- at least one wheel;
- a servo coupled to the at least one wheel and coupled to the battery; and
- a controller coupled to the servo and battery,
- the battery, the at least one wheel, the servo and the controller being housed in the device,
- wherein the controller is configured to control the servo to rotate the at least one wheel along the track in one direction to move the device in the one direction to open the sliding door and to control the servo to rotate the at least one wheel along the track in the opposite direction to move the device in the opposite direction to close the sliding door.

2. The device as in claim 1, further comprising:
- a first sprocket coupled to the servo;
- a second sprocket coupled to an axle of the at least one wheel; and
- a chain attached to the first sprocket and second sprocket.

3. The device as in claim 1, further comprising an antenna coupled to the controller.

4. The device as in claim 1, further comprising a camera coupled to the controller and the battery.

5. The device as in claim 1, further comprising a solar panel charger coupled to the battery.

6. The device as in claim 1, further comprising a speaker coupled to the controller and battery.

7. The device as in claim 1, further comprising a microphone coupled to the controller.

8. The device as in claim 7, wherein the controller receives sounds from the microphone and determines whether the sounds match a command to open or close the sliding door.

9. The device as in claim 1, further comprising an emergency switch coupled to the controller and the servo which will to stop the device from moving in either direction when the emergency switch is engaged.

10. The device as in claim 1, wherein the controller is configured to communicate with a remote device.

11. The device as in claim 1, wherein the controller is configured to communicate with a wireless router.

12. The device as in claim 1, wherein the battery is a rechargeable lithium battery.

13. The device as in claim 1, wherein the at least one wheel is a sprocket wheel.

14. The device as in claim 1, further comprising a bracket connected to the device and the sliding door.

15. A system for opening and closing sliding doors along a track, comprising:
- a device including,
  - a battery,
  - at least one wheel,
  - a servo coupled to the at least one wheel and coupled to the battery,
  - a controller coupled to the servo and battery, configured to control the servo to rotate the at least one wheel along the track in one direction to move the device in the one direction to open the sliding door and to control the servo to rotate the at least one wheel along the track in the opposite direction to move the device in the opposite direction to close the sliding door;
  - the battery, the at least one wheel, the servo and the controller being housed in the device; and
- a remote device for communicating with the controller to operate the device.

16. The system as in claim 15, wherein the remote device is a remote controller.

17. The system as in claim 15, wherein the remote device is a computer.

18. The system as in claim 15, wherein the remote device is a cellular phone.

19. A portable device for opening and closing a sliding door, the portable device comprising:
- a battery;
- at least one wheel;
- a servo coupled to the at least one wheel and coupled to the battery; and
- a controller coupled to the servo and battery,
- the battery, the at least one wheel, the servo and the controller being housed in the portable device; and
- wherein the controller is configured to move the portable device in one direction to open the sliding door and to move the portable device in the opposite direction to close the sliding door.

* * * * *